US008794609B2

(12) United States Patent
Kalambokas

(10) Patent No.: US 8,794,609 B2
(45) Date of Patent: Aug. 5, 2014

(54) MITER CLAMP

(71) Applicant: Trimclip LLC, Fairfield, CT (US)

(72) Inventor: Evans Kalambokas, Greenwich, CT (US)

(73) Assignee: Trim Clip, LLC, Fairfield, CT (US)

( * ) Notice: Subject to any disclaimer, the term of this patent is extended or adjusted under 35 U.S.C. 154(b) by 0 days.

(21) Appl. No.: 13/751,535

(22) Filed: Jan. 28, 2013

(65) Prior Publication Data

US 2013/0200558 A1 Aug. 8, 2013

Related U.S. Application Data

(60) Provisional application No. 61/591,539, filed on Jan. 27, 2012.

(51) Int. Cl.
*B25B 1/00* (2006.01)
*B25B 7/12* (2006.01)

(52) U.S. Cl.
USPC ..... 269/6; 81/381

(58) Field of Classification Search
CPC ..... B25B 5/06; B25B 7/00; B25B 7/02; B25B 7/06; B25B 7/08; B25B 7/10
USPC ..... 269/3, 6, 41, 95; 81/381, 383.5, 416, 81/418, 415, 427.5; 29/257, 258, 278
See application file for complete search history.

(56) References Cited

U.S. PATENT DOCUMENTS

| | | | | |
|---|---|---|---|---|
| 2,894,547 | A * | 7/1959 | Lampe | 81/351 |
| 3,134,281 | A * | 5/1964 | Mint | 81/3.44 |
| 4,899,445 | A * | 2/1990 | Erbrick et al. | 30/251 |
| 5,611,229 | A * | 3/1997 | Chadbourne et al. | 72/31.01 |
| 6,226,822 | B1 * | 5/2001 | Chen | 7/128 |
| 6,648,313 | B2 | 11/2003 | Navarro | |
| 2006/0213248 | A1 * | 9/2006 | Cleland et al. | 72/409.01 |
| 2008/0072716 | A1 * | 3/2008 | Chen | 81/423 |

OTHER PUBLICATIONS

"Wood Werks Supply: Clamp>>>> Miter Clamps", Wood Werks, available at http://woodwerks.com/miter-clamps-c-27_29.html, Jan. 14, 2013.
"M1201 Clamp Set", Maestro Company, available at http://maestrocompanyinc.com/M1201.html, Jan. 14, 2013.
"Hartford #62 Miter Clamps", Coastal Tool.com, available at http://www.coastaltool.com/clamps_vises/hartford/hartford_miter.htm, Jan. 14, 2013.

* cited by examiner

*Primary Examiner* — Lee D Wilson
*Assistant Examiner* — Nirvana Deonauth

(57) ABSTRACT

The present invention relates generally to a clamp for achieving tight miter joints in wood casings or other materials comprising mitered ends. The clamp according to the present invention comprises a first handle and a second handle attached to each other to form a handle member and a first jaw and a second jaw attached to each other a clamping member. The handle member and clamping member are attached to each other in a manner that creates an over center cam mechanism that prevents the clamping member from opening unless the handle member is also opened.

9 Claims, 12 Drawing Sheets

MITER CLAMP

CROSS REFERENCE TO RELATED APPLICATIONS

This application claims the benefit of U.S. Provisional Application No. 61/591,539, filed Jan. 27, 2012, which is hereby incorporated by reference in its entirety.

FIELD OF INVENTION

The present invention relates generally to a clamp for achieving tight miter joints in wood casings or other materials comprising mitered ends.

BACKGROUND OF THE INVENTION

When using other products that are known in the art for clamping together materials to secure a miter joint, many of these products require the user to constantly squeeze the handles of the clamp in order to keep the clamp in an open position. Exerting this amount of pressure requires a substantial amount of effort by the user. Additionally, because of this difficulty for the user to install the clamp on the work piece, it can be difficult to make adjustments in placing the clamp.

What is needed is a miter clamp that is configured to stay open effortlessly and allows the user to adjust the clamp to line up the mitered corners until the user is ready to squeeze the clamp closed, therefore reducing hand fatigue.

SUMMARY OF THE INVENTION

The present invention is directed to a clamping apparatus for squeezing together two miter joint members so as to conveniently achieve a miter joint of a wood casing. The apparatus comprises a handle having an end portion with a first coupling portion and a second coupling portion and a corresponding handle having a corresponding end portion with a corresponding first coupling portion and a corresponding second coupling portion. The handle is pivotally attached to the corresponding handle by a first pivot point arrangement formed by coupling the first coupling portion and the corresponding first coupling portion together so as to form a handle member having an opening position caused by moving apart the handle and the corresponding handle, and also having a closed position caused by moving together the handle and the corresponding handle.

The clamping apparatus also comprises a jaw and a corresponding jaw which form a clamping member. The jaw has a first jaw end with a first jaw coupling portion and a second jaw coupling portion, and has a second jaw end with a clamping portion. The corresponding jaw has a corresponding jaw end with a cam-based portion. The cam-based portion includes a corresponding jaw first coupling portion and a corresponding jaw second coupling portion. The corresponding jaw also has a corresponding jaw second end with a corresponding clamping portion. The cam-based portion is configured to form a recessed portion.

The handle member is pivotally attached to the clamping member by a second pivot point arrangement formed by coupling the second coupling portion of the handle and the first jaw coupling portion of the jaw and also by a third pivot point arrangement formed by coupling the corresponding second coupling portion of the corresponding handle and the corresponding first jaw coupling portion of the corresponding jaw. The jaw is pivotally coupled to the corresponding jaw by a fourth pivot point arrangement formed by coupling the second jaw coupling portion of the jaw and the corresponding second jaw coupling portion of the corresponding jaw.

In response to the handle member being moved from the open position to the closed position, the clamping member is moved from an unlocked position to a locked position so that the first pivot point arrangement is received in the recessed portion of the cam-based portion of the corresponding jaw, and also so that the clamping portion of the jaw and the corresponding clamping portion of the corresponding jaw squeeze together two miter joint members and achieve a miter joint of a wood casing. Furthermore, only in response to the handle member being moved from the closed position to the open position, the first pivot point arrangement is moved away from the recessed portion of the cam-based portion of the corresponding jaw in order to release and move the clamping member from the locked position to the unlocked position to remove the clamping member from the two miter joint members.

According to an embodiment of the invention, when the clamping member is in the locked position and the handle member is in the closed position, the first pivot point arrangement, the second pivot point arrangement and the third pivot point arrangement are configured to be aligned. When the clamping member is in the unlocked position and the handle member is in the open position, the first pivot point arrangement, the second pivot point arrangement and the third pivot point arrangement are configured not to be aligned. When the clamping member is moved from the locked position to the unlocked position, the first pivot point arrangement and the fourth pivot point arrangement are configured to move away from each other, and the second pivot point arrangement and the third pivot point arrangement are configured to move towards each other. When the clamping member is moved from the unlocked position to the locked position, the first pivot point arrangement and the fourth pivot point arrangement are configured to move towards each other, and the second pivot point arrangement and the third pivot point arrangement are configured to move away from each other.

According further to an embodiment of the invention, the first jaw end includes a tip and the corresponding first jaw end includes a corresponding tip. Each tip is configured engage and squeeze two miter joint members together and achieve the tight miter joint of a wood casing when the clamping member is in the locked position and the handle member is in the closed position. The tip and the corresponding tip are made of steel in a preferred embodiment.

According further to an embodiment of the invention, the handle members are configured with an I-beam construction. The cam-based portion of the corresponding jaw comprises a set point configured to receive the two miter joint members.

The first coupling portion and the second coupling portion of the handle, the corresponding first coupling portion and the corresponding second coupling portion of the corresponding handle, the first jaw coupling portion and the second jaw coupling portion of the jaw, and the corresponding first jaw coupling portion and the corresponding second jaw coupling portion of the corresponding jaw is formed with a respective aperture configured to receive a respective pivot pin that forms part of a respective pivot point arrangement.

The apparatus according to the invention comprises an over center cam mechanism, also referred to as a reverse cam. When the handles of the apparatus are fully closed, the jaws cannot open until the handles are released. The pressure on the tips of the clamp results from the greater than 45 degree travel embedded in the wood joint. The clamp can be used on any pieces of material having a mitered end comprising a 22.5 to 45 degree angles, and, for example, when installing window and door casings, picture frames, square, octagonal or hexagonal shaped items, stairway rails, or planters. After an individual has cut their miter joints, glue can be applied to each piece and the two pieces are joined together. The apparatus of the present invention is then applied and the applied glue is allowed to dry, or the two pieces can be further secured with nails while the apparatus is in place.

BRIEF DESCRIPTION OF THE DRAWINGS

Figure 1:
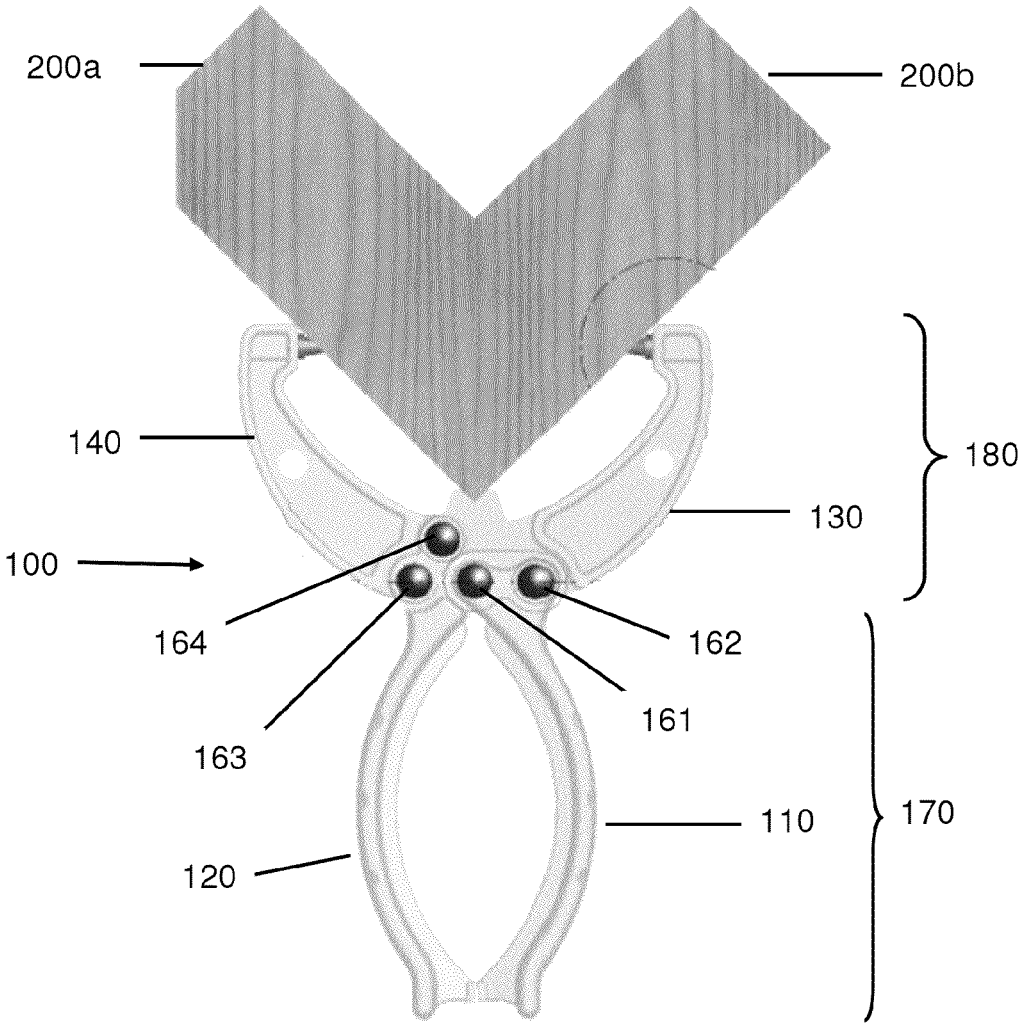
Figure 2A:
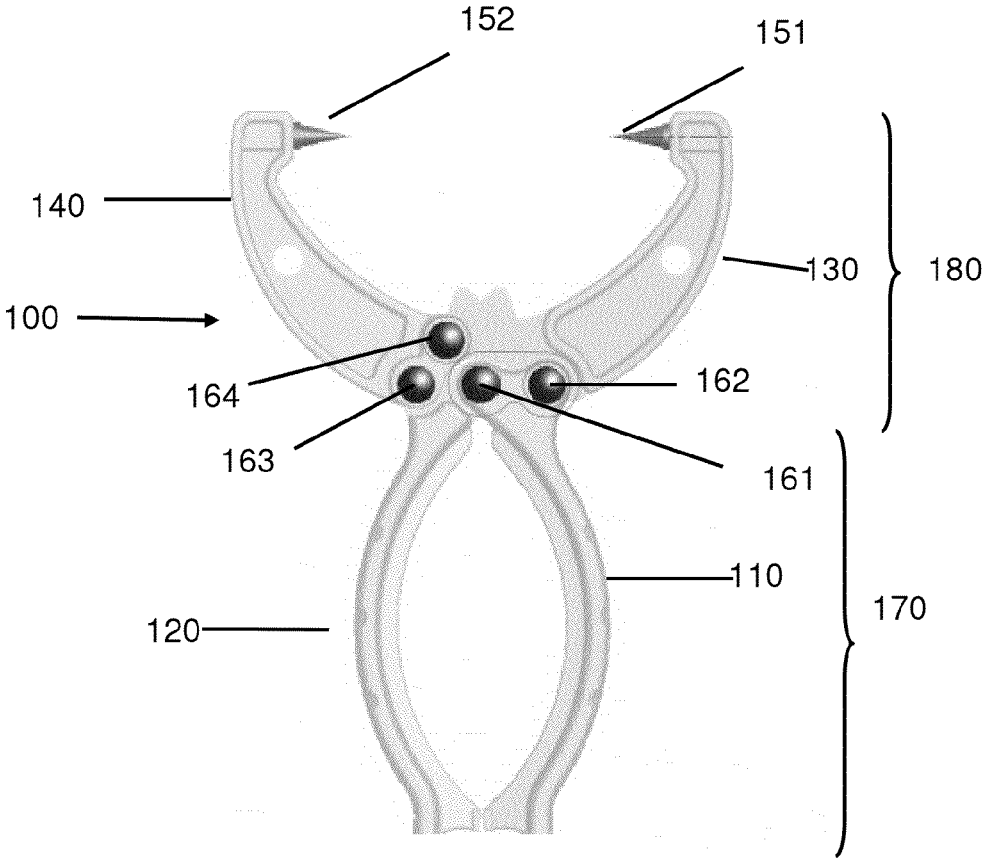
Figure 2B:
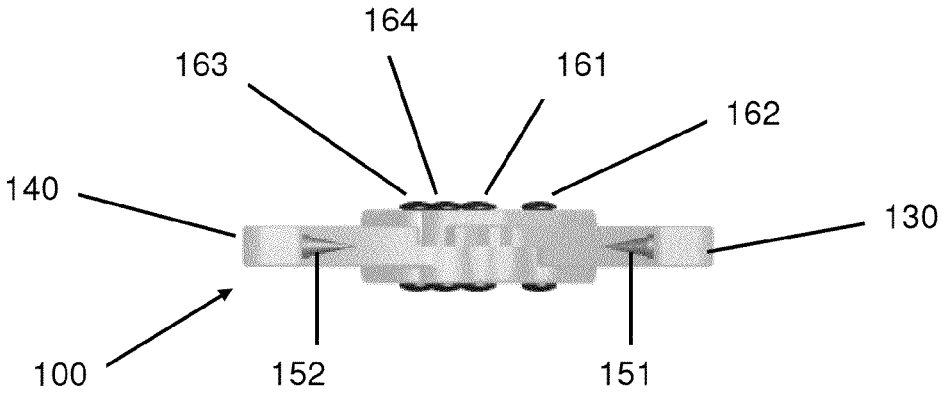
Figure 3A:
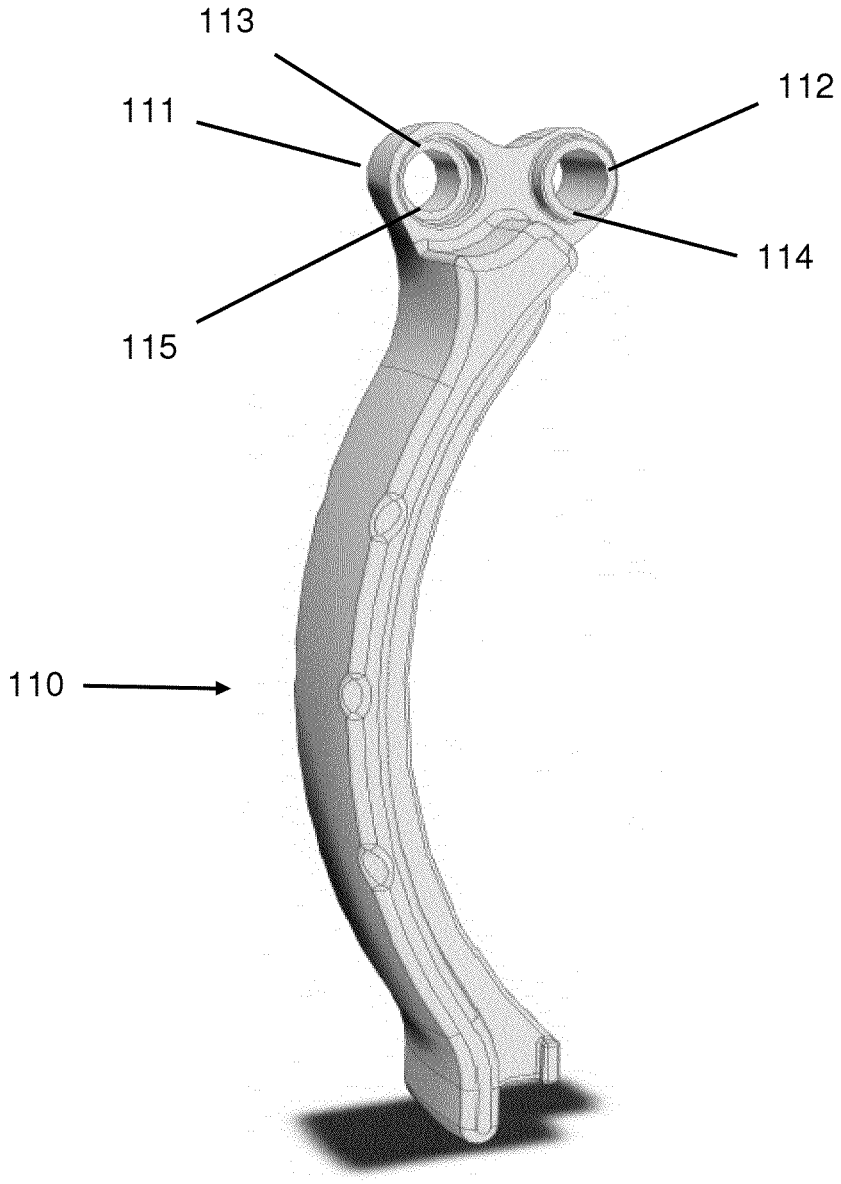
Figure 3B:
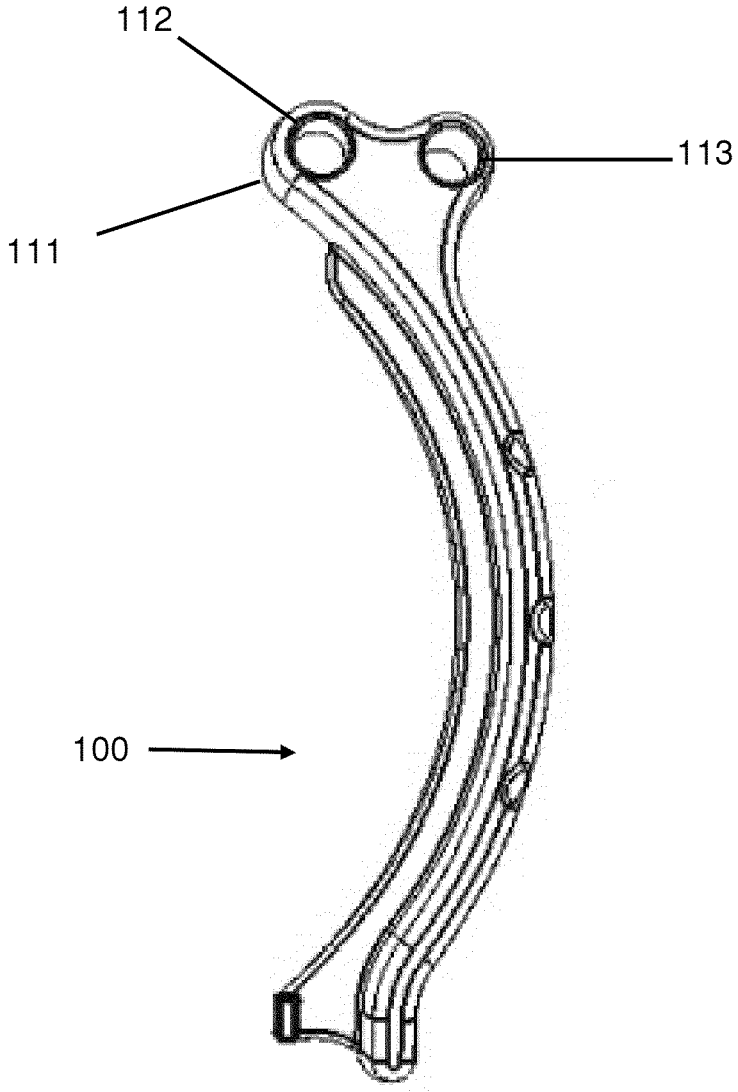
Figure 4A:
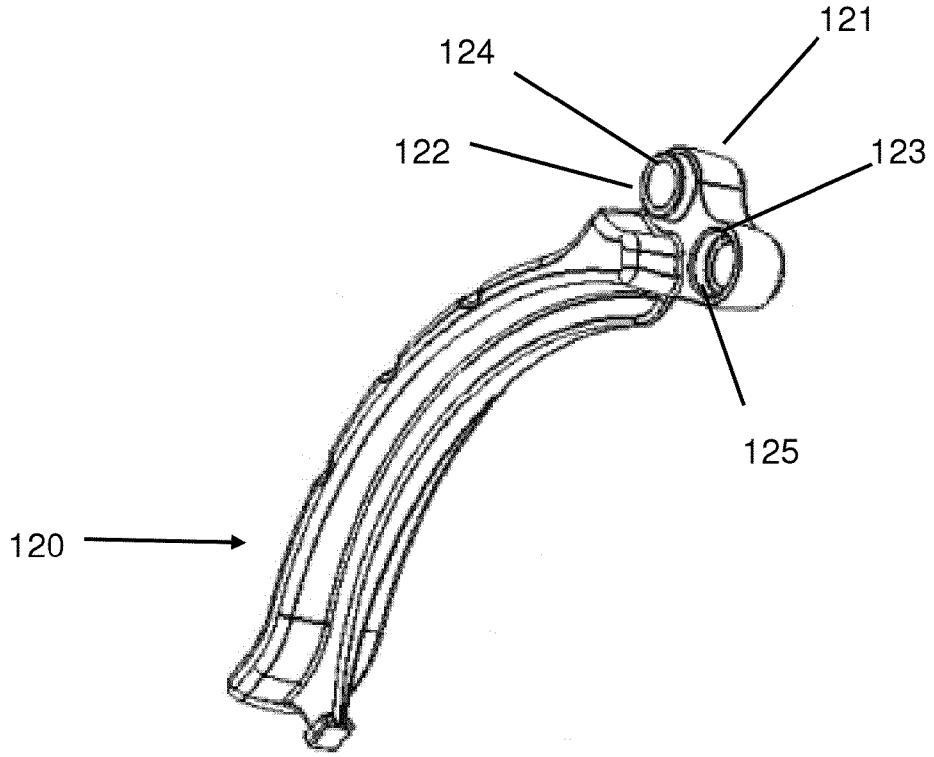
Figure 4B:
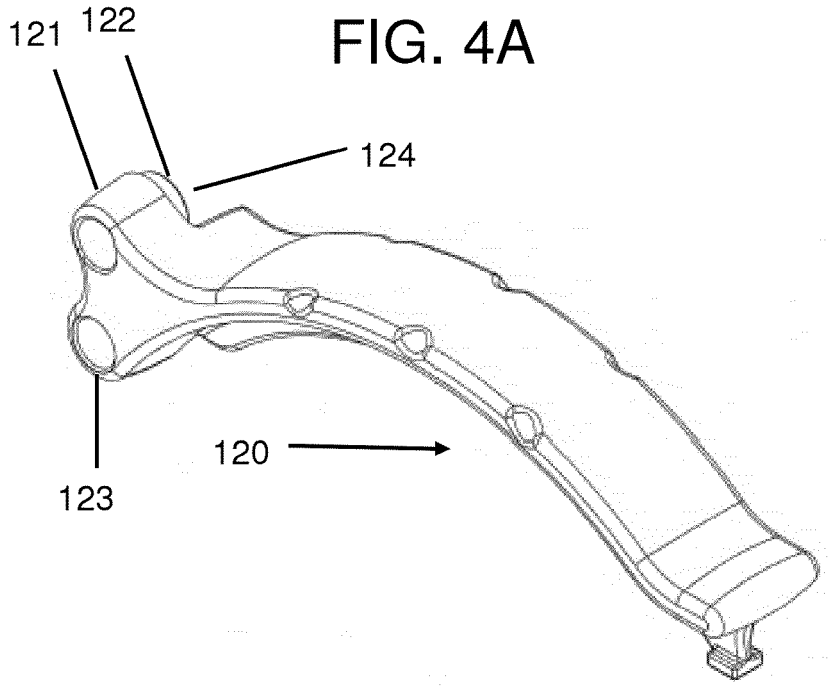
Figure 5A:
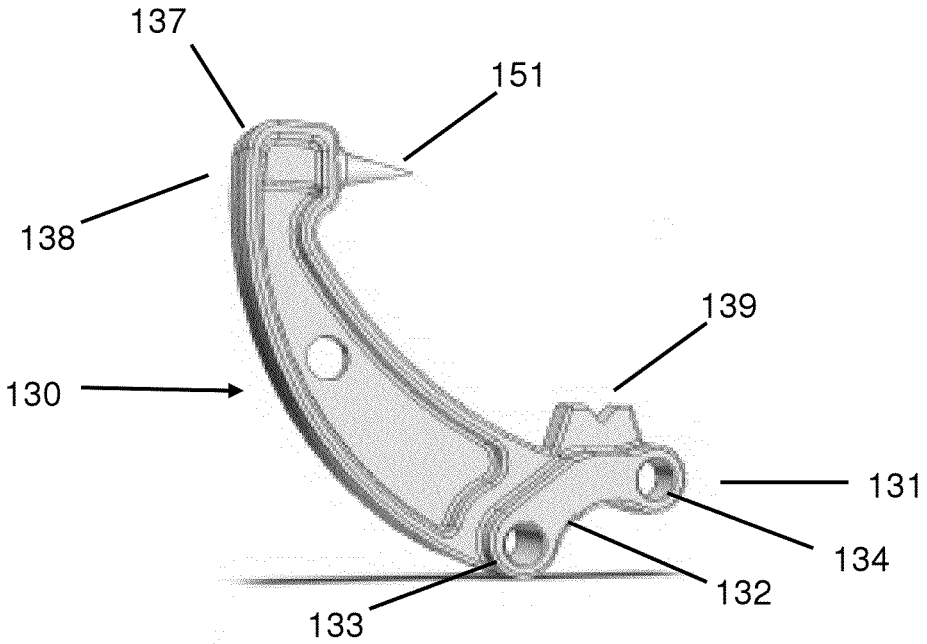
Figure 5B:
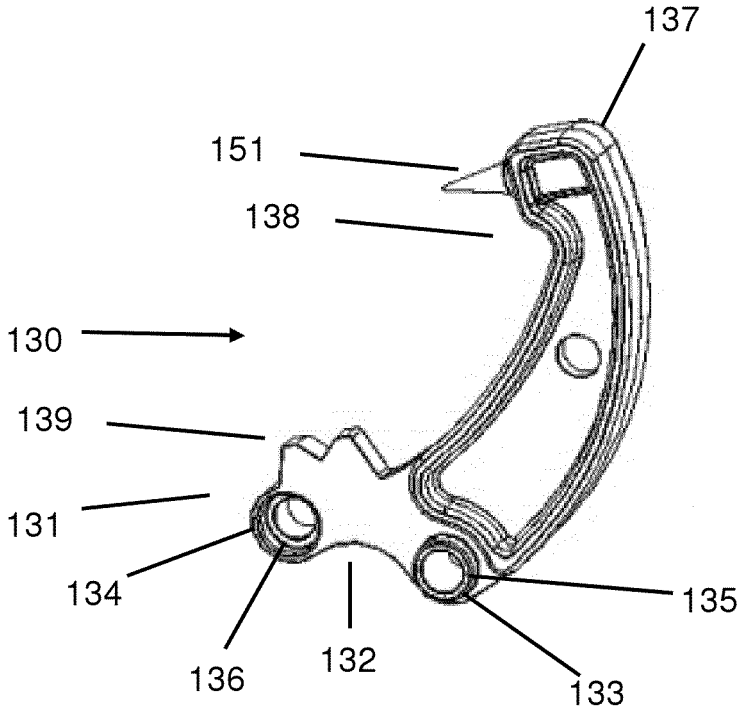
Figure 6A:
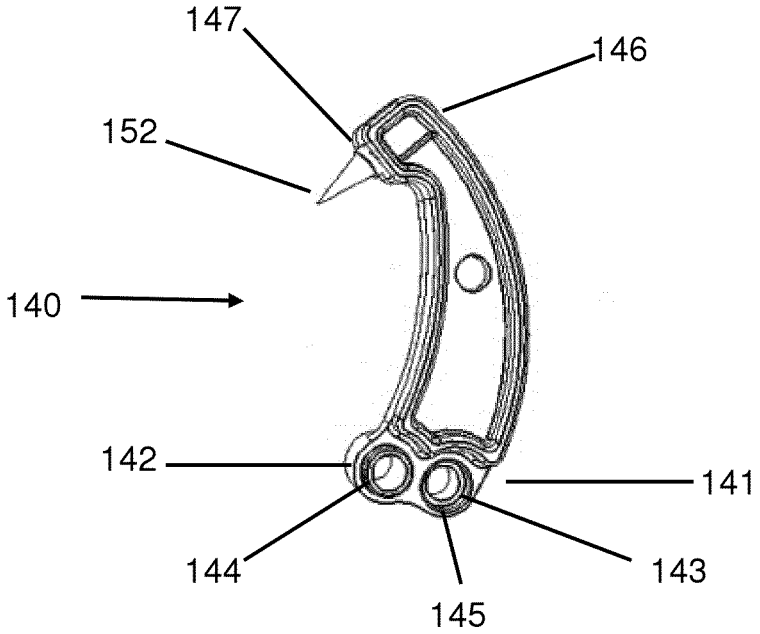
Figure 6B:
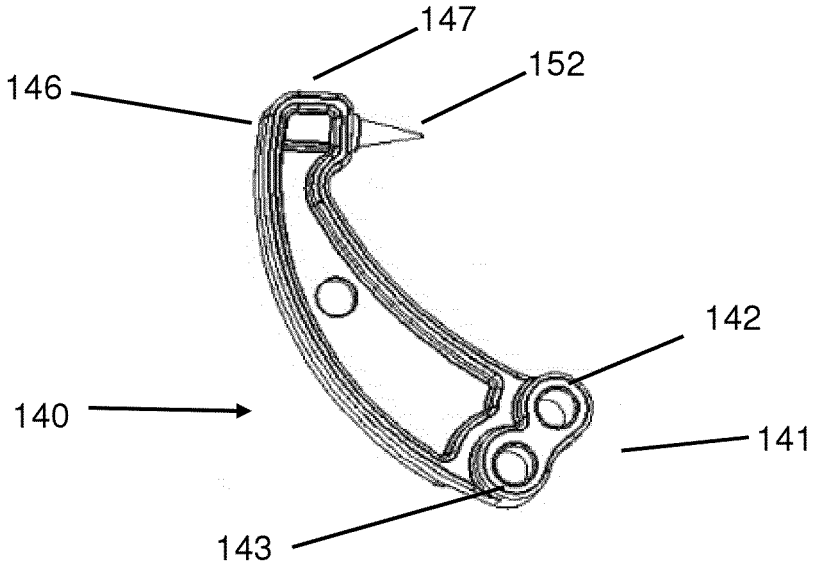
Figure 7A:
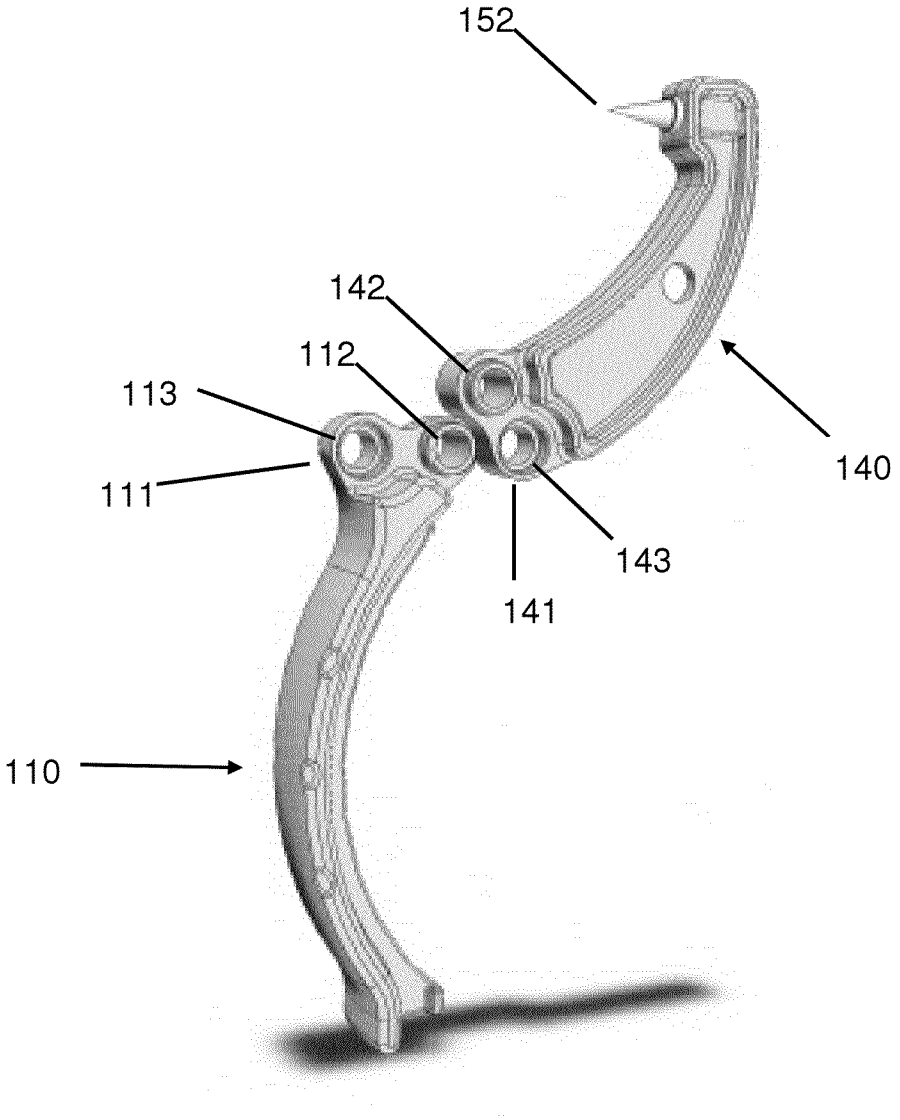
Figure 7B:
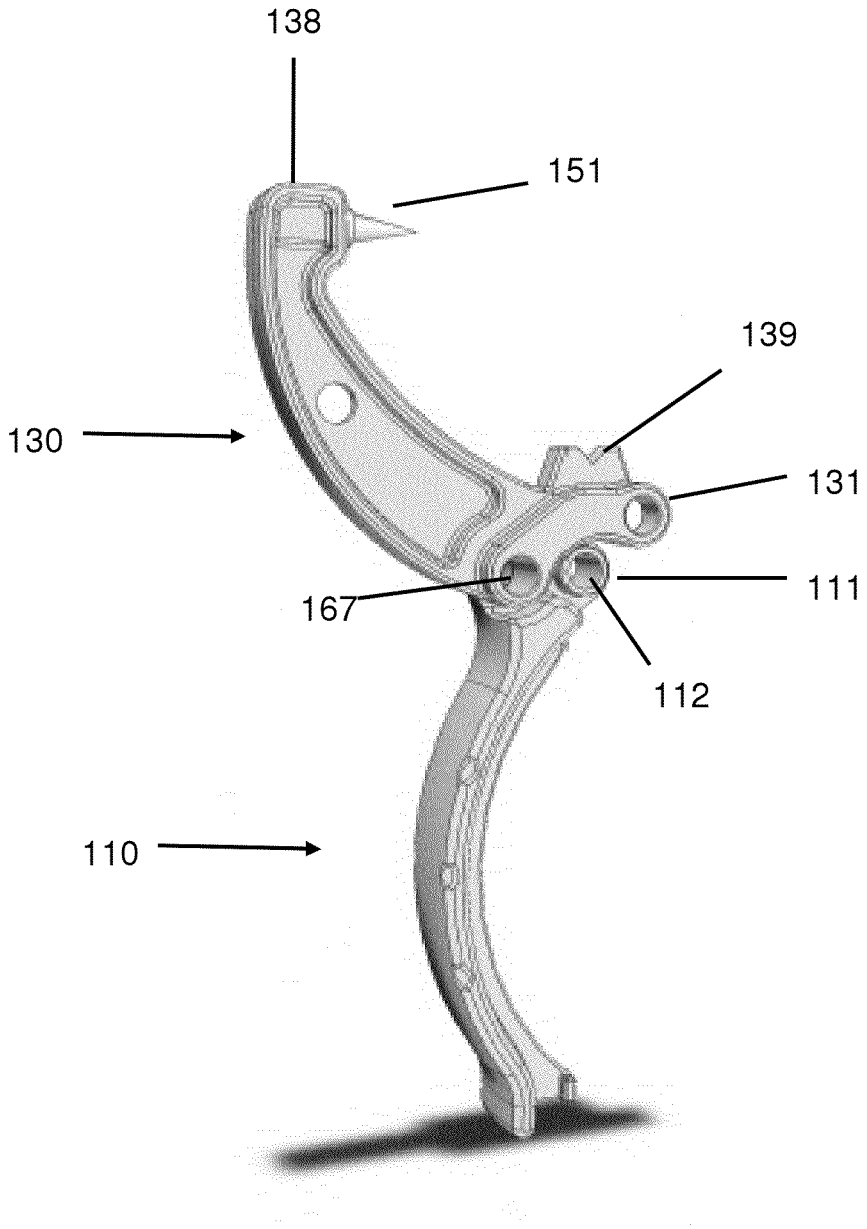
Figure 7C:
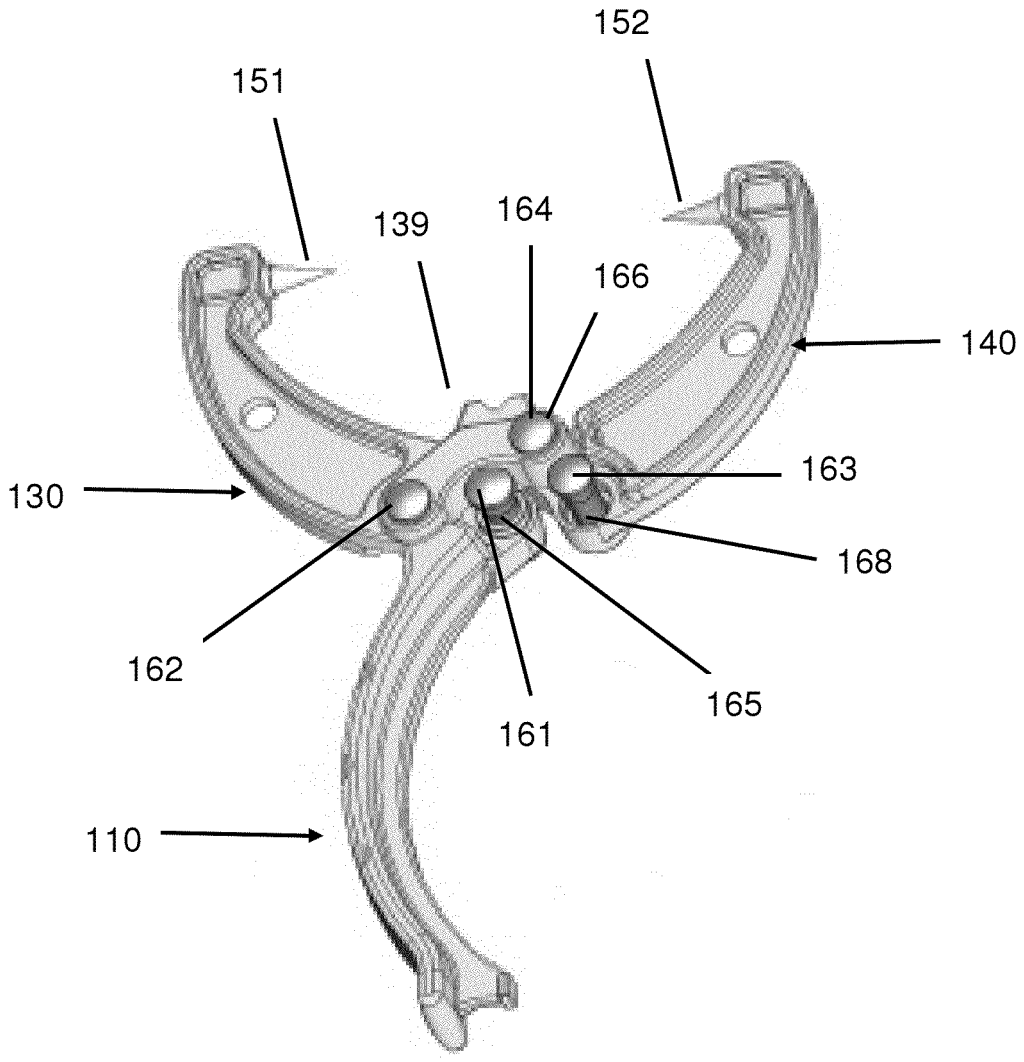
Figure 8:
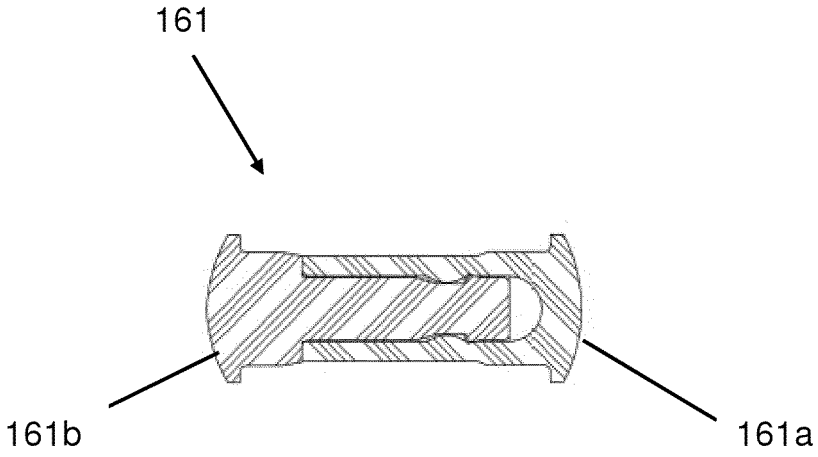
Figure 9A:
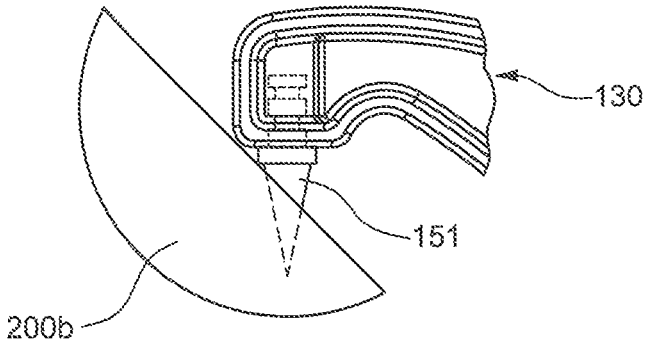
Figure 9B:
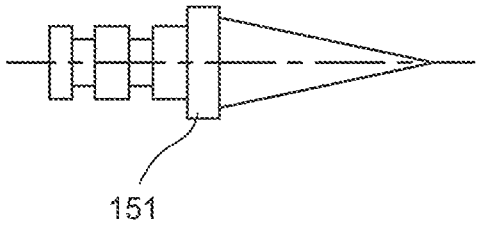

Having thus described the invention in general terms, reference will now be made to the accompanying drawings, which are not necessarily drawn to scale, where:

FIG. 1 shows a perspective view of the apparatus according to an embodiment of the invention as used in connection with two pieces of material having a mitered end;

FIG. 2A shows a perspective view of an apparatus according to an embodiment of the invention;

FIG. 2B shows an overhead view of an apparatus according to an embodiment of the invention;

FIG. 3A shows a perspective view of a first handle according to an embodiment of the invention;

FIG. 3B shows a reverse perspective view of the first handle according to an embodiment of the invention;

FIG. 4A shows a perspective view of a second handle according to an embodiment of the invention;

FIG. 4B shows a reverse perspective view of the second handle according to an embodiment of the invention;

FIG. 5A shows a perspective view of a first jaw according to an embodiment of the invention;

FIG. 5B shows a reverse perspective view of the first jaw according to an embodiment of the invention comprising apparatuses affixed to a surface and wires;

FIG. 6A shows a perspective view of a second jaw according to an embodiment of the invention;

FIG. 6B shows a reverse perspective view of the second jaw according to an embodiment of the invention;

FIG. 7A shows a first handle in combination with a second jaw according to an embodiment of the invention;

FIG. 7B shows a first handle in combination with a first jaw according to an embodiment of the invention;

FIG. 7C shows a first handle in combination with a first jaw and a second jaw according to an embodiment of the invention;

FIG. 8 shows a cross-sectional view of a mating pin according to an embodiment of the invention;

FIG. 9A shows a partially transparent view of a tip inserted into a piece of wood or other material according to an embodiment of the invention; and FIG. 9B shows a perspective view of a tip according to an embodiment of the invention.

DETAILED DESCRIPTION OF THE DRAWINGS

The present invention now will be described more fully hereinafter with reference to the accompanying figures, in which exemplary embodiments of the invention are shown. The invention may, however, be embodied in many different forms and should not be construed as limited to the embodiments set forth herein.

It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention. Use of identifying terms such as "first" or "second" are for identification purposes only.

As shown in FIGS. 1 through 2B, the apparatus 100 according to the present invention is configured for squeezing together two miter joint members 200*a*, 200*b* so as to achieve a miter joint of a wood casing. The apparatus 100 has four main working parts: a first handle 110, a second handle 120, a first jaw 130 and a second jaw 140. The apparatus 100 also comprises two pins 151, 152. Each of the pins 151, 152 are molded into the first jaw 130 and second jaw 140, respectively. The apparatus also comprises four mating pins 161, 162, 163, 164 configured to secure the four handle and jaw components together.

In an exemplary embodiment, the material for the handles 110, 120 and jaws 130, 140 are made from a polycarbonate material, the pins are machined from stainless steel, and the mating pins 161, 162, 163, 164 are made of nylon and polycarbonate components. However, the materials used to construct the invention are not limited to any particular material or set of materials.

Shown, for example, in FIGS. 3A and 3B, the first handle 110 according to the present invention comprises an end portion 111 with a first coupling portion 112 and an adjacent, second coupling portion 113. Each of the first coupling portion 112 and second coupling portion 113 includes an opening spanning through the first handle 110. The first coupling portion 112 comprises a lip or pivot pin 114 emerging out from the first handle 110 and surrounding the opening of the first coupling portion 112. The second coupling portion 113 comprises an aperture 115 indented into the first handle 110 and surrounding the opening of the second coupling portion 113. In a preferred embodiment, the lip 114 and aperture 115 are substantially the same size and shape. The first handle 110 also comprises an I-beam configuration.

Shown, for example, in FIGS. 4A and 4B, the second handle 120 according to the present invention comprises an end portion 121 with a first coupling portion 122 and an adjacent, second coupling portion 123. Each of the first coupling portion 122 and second coupling portion 123 includes an opening spanning through the second handle 120. The first coupling portion 122 comprises a lip or pivot pin 124 emerging out from the second handle 120 and surrounding the opening of the first coupling portion 122. The second coupling portion 123 comprises an aperture 125 indented into the second handle 120 and surrounding the opening of the second coupling portion 122. In a preferred embodiment, the lip 124 and aperture 125 are substantially the same size and shape. The second handle 120 also comprises an I-beam configuration.

The second handle 120 forms a corresponding handle relative to the first handle 110. In a preferred embodiment, the first handle 110 and second handle 120 are substantially the same size and shape, however, as seen in FIGS. 3A and 4A, the relative positions of the respective first coupling portions 112, 122 and second coupling portions 113, 123 differ to allow for the coupling of the first handle 110 to the second handle 120 in a pivoting relationship.

Shown, for example, in FIGS. 5A and 5B, the first jaw 130 of the apparatus 100 has a first end 131 comprising a cam-based portion 132. The cam-based portion 132 comprises a first coupling portion 133 and an adjacent second coupling portion 134. Each of the first coupling portion 133 and second coupling portion 134 includes an opening spanning through the first jaw 130. The opening of the first coupling portion 133 comprises a lip or pivot pin 135 emerging out from the first jaw 130 and surrounding the opening of the first coupling portion 133. In a preferred embodiment, the second coupling portion 134 comprises an aperture 136 indented into the first jaw 130 and surrounding the opening of the second coupling portion 134. The aperture 135 and lip 136 are substantially the same size and shape. The cam-based portion 132 of the first jaw 130 is configured to form a recessed portion at the first end 131.

The first jaw 130 further comprises a second end 137 comprising a clamping portion 138. The clamping portion of the first jaw 130 comprises a pin or tip 151 with a pointed end configured for applying pressure to a piece of material when the apparatus 100 is used in operation. The pin or tip 151, preferably used in combination with another, opposing pin or tip 152, is configured to engage and squeeze one of the two miter joint members 200*a*, 200*b* to the other and achieve a tight miter joint of the wood casing when the clamping member 180 is in the locked position and the handle member 170 is in the closed position. The pin or tip 151 is molded into the second end 137 of the first jaw 130.

The first jaw 130 comprises a notch 139 configured to receive and secure together the two mitered corners 200*a*, 200*b*. In one embodiment, the notch 139 comprises a right angle notch. The cam-based portion 132 of the first jaw 130 comprises this notch 139 to receive the two miter joint members 200*a*, 200*b* when the apparatus 100 is used. In a preferred embodiment, the notch 139 is positioned on the first jaw 130 so that it is substantially centrally located between the first jaw 130 and second jaw 140 at the base of the clamping member 180 of the constructed apparatus 100.

Shown, for example, in FIGS. 6A and 6B, the second jaw 140 of the apparatus 100 comprises a first end 141 comprising a first coupling portion 142 and an adjacent second coupling portion 143. Each of the first coupling portion 142 and second coupling portion 143 includes an opening spanning through the second jaw 140. The opening of the first coupling portion 142 comprises a lip or pivot pin 144 emerging from the second jaw 140 surrounding the opening of the first coupling portion 142. In a preferred embodiment, the second coupling portion 143 comprises an aperture 145 indented into the second jaw 140 and surrounding the opening of the second coupling portion 143. The lip 144 and aperture 145 are substantially the same size and shape.

The second jaw 140 further comprises a second end 146 comprising a corresponding clamping portion 147. The clamping portion 147 of the second jaw 140 also comprises a pin or tip 152 with a pointed end configured for applying pressure to a piece of material when the apparatus 100 is used in operation.

The apparatus 100 is constructed from the individual first and second handles 110 and 120 and first and second jaws 130 and 140 by integrating the four components together.

The first handle 110 is attached to the second handle 120 to form a handle member 170. The first handle 110 is pivotally attached to the corresponding second handle 120 in a pivot point arrangement formed by coupling together the first coupling portion 112 of the first handle 110 and the corresponding second coupling portion 123 of the second handle 120. The lip 114 of the first coupling portion 112 of the first handle 110 is inserted into the corresponding aperture 125 of the second coupling portion 123 of the second handle 120. The overlapping openings of the coupling portions 112, 123 are configured to form a channel 165. The handle member 170 has an open position caused by moving the first handle 110 and second handle 120 apart, and a closed position caused by moving first handle 110 and second handle 120 together.

The first jaw 130 is attached to the second jaw 140 attached to form a clamping member 180. The first jaw 130 is pivotally attached to the corresponding second jaw 140 in a pivot point arrangement formed by coupling together the first coupling portion 142 of the second jaw 140 and the corresponding second coupling portion 134 of the first jaw 130. The lip 144 of the first coupling portion 142 of the second jaw 140 is inserted into the corresponding aperture 136 of the second coupling portion 134 of the first jaw 130. The overlapping openings of the coupling portions 142, 134 are configured to form to form a channel 166.

The handle member 170 is pivotally attached to the clamping member 180 by attaching the first handle 110 to the first jaw 130 and attaching the second handle 120 to the second jaw 140.

The first handle 110 is pivotally attached to the corresponding first jaw 130 by a pivot point arrangement formed by coupling together the first coupling portion 133 of the first jaw 130 and the corresponding second coupling portion 113 of the first handle 110. The lip 135 of the first coupling portion 133 of the first jaw 130 is inserted into the corresponding aperture 115 of the second coupling portion 113 of the first handle 110. The overlapping openings of the coupling portions 133, 113 are configured to form to form a channel 167.

The second handle 120 is pivotally attached to the corresponding second jaw 140 by a pivot point arrangement formed by coupling together the first coupling portion 122 of the second handle 120 and the corresponding second coupling portion 143 of the second jaw 140. The lip 124 of the first coupling portion 122 of the second handle 120 is inserted into the corresponding aperture 146 of the second coupling portion 143 of the second jaw 140. The overlapping openings of the coupling portions 122, 143 are configured to form to form a channel 168.

Each of the first handle 110, second handle 120, first jaw 130 and second jaw 140 are configured to provide a compact construction of the apparatus 100. As illustrated in the Figures, particularly FIGS. 7A and 7B, each of the end portions 111, 121, 131, 141 of the handles and jaws comprises a recessed portion positioned in between their respective first and second coupling portions. When the apparatus 100 is in its constructed state, these recessed portions provide space to position the first or second coupling member of another jaw or handle, which are dimensioned to fit in the recessed portions of the end portions 111, 121, 131, 141. This construction also provides the apparatus 100 with an over-center cam mechanism for operating the apparatus 100.

In addition to coupling the first handle 110, second handle 120, first jaw 130 and second jaw 140 together with their respective first and second coupling portions, a series of mating pins 161, 162, 163, 164 are inserted through the channels 165, 167, 168 and 166, respectively, to secure the components together.

Specifically, a mating pin 161 is used to secure the first handle 110 to the second handle 120, a mating pin 162 is used to secure the first handle 110 to the first jaw 130, a mating pin 163 is used to secure the second handle 120 to the second jaw 140, and a mating pin 164 is used to secure the first jaw 130 to the second jaw 140. Mating pins 161, 162, and 163 are substantially aligned when the handle member 170 is in a closed configuration. Mating pins 161, 162, 163 and 164 each comprise two components. As shown for example in FIG. 8, mating pin 161 is formed from a hollowed out portion 161*a* inserted into and secured to a scalloped portion 161*b*.

Mating pins 161, 163, and 164 are configured to create an over center cam mechanism preventing the clamping member 180 from opening if the handle member 170 is not released.

In response to the handle member 170 being moved from the open position to the closed position, the clamping member 180 is moved from an unlocked position to a locked position.

In the locked position, the pivot point at mating pin 161 is received in the recessed portion of the cam-based portion 132 of the first jaw 130. The clamping portion 138 of the first jaw 130 and the corresponding clamping portion 147 of the second jaw 140 squeeze together two miter joint members 200*a*, 200*b* and achieve a miter joint. The squeezing together of the miter joint members 200*a*, 200*b* is aided by the pins 151, 152 comprised on each of the jaws 130 and 140. The pins 151, 152 can be inserted into the miter joint members 200*a*, 200*b* to apply additional clamping pressure to the miter joint members 200*a*, 200*b*, as shown in FIG. 9A.

It is only in response to the handle member 170 being moved from the closed position to the open position, that the pivot point at mating pin 161 is moved away from the recessed portion of the cam-based portion 132 of the first jaw 130 in order to release and move the clamping member 180 from the locked position to the unlocked position in to remove the clamping member 180 from the two miter joint members 200*a*, 200*b*. The three pivot points at mating pins 161, 162 and 163 are configured to be aligned when the clamping member 180 is in the locked position and the handle member 170 is in the closed position. The three pivot points at mating pins 161, 162 and 163 are configured to not be aligned when the clamping member 180 is in the unlocked position and the handle member 170 is in the open position.

When the clamping member 180 is moved from the locked position to the unlocked position, the pivot points at mating pins 161 and 164 are configured to move away from each other, and the pivot points at mating pins 162 and 163 are configured to move towards from each other.

When the clamping member 180 is moved from the unlocked position to the locked position, the pivot points at mating pins 161 and 164 are configured to move towards each other, and the pivot points at mating pins 162 and 163 are configured to move away from each other.

What is claimed:

1. An apparatus for squeezing together two miter joint members so as to achieve a miter joint of a wood casing, comprising:

a handle having an end portion with a first coupling portion and a second coupling portion;

a corresponding handle having a corresponding end portion with a corresponding first coupling portion and a corresponding second coupling portion;

the handle being pivotally attached to the corresponding handle by a first pivot point arrangement formed by coupling the first coupling portion and the corresponding first coupling portion together so as to form a handle member having an opening position caused by moving apart the handle and the corresponding handle, and also having a closed position caused by moving together the handle and the corresponding handle;

a jaw having a first jaw end with a first jaw coupling portion and a second jaw coupling portion, and having a second jaw end with a clamping portion;

a corresponding jaw having a corresponding jaw end with a cam-based portion, the cam-based portion having a corresponding jaw first coupling portion and a corresponding jaw second coupling portion, the corresponding jaw also having a corresponding jaw second end with a corresponding clamping portion, the cam-based portion configured to form a recessed portion;

the handle member being pivotally attached to the clamping member by a second pivot point arrangement formed by coupling the second coupling portion of the handle and the first jaw coupling portion of the jaw and also by a third pivot point arrangement formed by coupling the corresponding second coupling portion of the corresponding handle and the corresponding first jaw coupling portion of the corresponding jaw;

the jaw being pivotally coupled to the corresponding jaw by a fourth pivot point arrangement formed by coupling the second jaw coupling portion of the jaw and the corresponding second jaw coupling portion of the corresponding jaw;

in response to the handle member being moved from the open position to the closed position, the clamping member is moved from an unlocked position to a locked position so that the first pivot point arrangement is received in the recessed portion of the cam-based portion of the corresponding jaw, and also so that the clamping portion of the jaw and the corresponding clamping portion of the corresponding jaw squeeze together two miter joint members and achieve a miter joint of a wood casing; and only in response to the handle member being moved from the closed position to the open position, the first pivot point arrangement is moved away from the recessed portion of the cam-based portion of the corresponding jaw in order to release and move the clamping member from the locked position to the unlocked position to remove the clamping member from the two miter joint members.

2. An apparatus according to claim 1, wherein the first pivot point arrangement, the second pivot point arrangement and the third pivot point arrangement are configured to be aligned when the clamping member is in the locked position and the handle member is in the closed position; and the first pivot point arrangement, the second pivot point arrangement and the third pivot point arrangement are configured not to be aligned when the clamping member is in the unlocked position and the handle member is in the open position.

3. An apparatus according to claim 1, wherein the first pivot point arrangement and the fourth pivot point arrangement are configured to move away from each other, and the second pivot point arrangement and the third pivot point arrangement are configured to move towards from each other, when the clamping member is moved from the locked position to the unlocked position.

4. An apparatus according to claim 1, wherein the first pivot point arrangement and the fourth pivot point arrangement are configured to move towards each other, and the second pivot point arrangement and the third pivot point arrangement are configured to move away from each other, when the clamping member is moved from the unlocked position to the locked position.

5. An apparatus according to claim 1 wherein the first jaw end includes a tip and the corresponding first jaw end includes a corresponding tip, each tip configured engage and squeeze the two miter joint members together and achieve the tight miter joint of the wood casing when the clamping member is in the locked position and the handle member is in the closed position.

6. An apparatus according to claim 5, wherein the tip and the corresponding tip are made of steel.

7. An apparatus according to claim 1, wherein the handle members are configured with an I-beam construction.

8. An apparatus according to claim 1, wherein the cam-based portion of the corresponding jaw comprises a set point configured to receive the two miter joint members.

9. An apparatus according to claim 1, wherein each of the first coupling portion and the second coupling portion of the handle, the corresponding first coupling portion and the corresponding second coupling portion of the corresponding handle, the first jaw coupling portion and the second jaw coupling portion of the jaw, and the corresponding first jaw coupling portion and the corresponding second jaw coupling portion of the corresponding jaw is formed with a respective aperture configured to receive a respective pivot pin that forms part of a respective pivot point arrangement.

* * * * *